US008810504B2

(12) United States Patent
Yu et al.

(10) Patent No.: US 8,810,504 B2
(45) Date of Patent: Aug. 19, 2014

(54) BRIGHTNESS COMPENSATION METHOD AND LOCAL DIMMING CIRCUIT AND LIQUID CRYSTAL DISPLAY THEREOF

(75) Inventors: Heng Yu, Shanghai (CN); Min Wei, Guangdong (CN); Jiande Jiang, Shaanxi (CN)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 125 days.

(21) Appl. No.: 13/553,803

(22) Filed: Jul. 19, 2012

(65) Prior Publication Data

US 2013/0265346 A1 Oct. 10, 2013

(30) Foreign Application Priority Data

Apr. 6, 2012 (CN) ..... 2012 1 0099945

(51) Int. Cl.
*G09G 3/36* (2006.01)

(52) U.S. Cl.
USPC ..... 345/102

(58) Field of Classification Search
USPC ..... 345/102; 349/61–70; 362/561
See application file for complete search history.

(56) References Cited

U.S. PATENT DOCUMENTS

2008/0068328 A1* 3/2008 Jou et al. ..... 345/102
2008/0278432 A1* 11/2008 Ohshima ..... 345/102
2011/0122171 A1* 5/2011 Kwon et al. ..... 345/690

* cited by examiner

*Primary Examiner* — Chanh Nguyen
*Assistant Examiner* — Ram Mistry
(74) *Attorney, Agent, or Firm* — Winston Hsu; Scott Margo

(57) ABSTRACT

The present invention discloses a brightness compensation method. The brightness compensation method includes controlling a plurality of backlights of a plurality of display areas to turn on with a plurality of backlight intensity; calculating a plurality of total backlight intensity; calculating a plurality of actual backlight intensity according to the plurality of total backlight intensity and a backlight scanning ratio; dividing a plurality of maximum backlight intensity when the plurality of backlights are fully turned on by the plurality of actual backlight intensity, to generate a plurality of compensation gains; and displaying a compensated image data with a plurality of compensated image intensity after compensating a plurality of image intensity corresponding to the plurality of display area of an image data with the plurality of compensation gains.

8 Claims, 2 Drawing Sheets

BRIGHTNESS COMPENSATION METHOD AND LOCAL DIMMING CIRCUIT AND LIQUID CRYSTAL DISPLAY THEREOF

BACKGROUND OF THE INVENTION

1. Field of the Invention

The present invention relates to a brightness compensation method and a local dimming circuit and a liquid crystal display thereof, and more particularly, to a brightness compensation method and a local dimming circuit and a liquid crystal display thereof which can compensate intensity loss of both local dimming and backlight scanning, to display a normal image.

2. Description of the Prior Art

In general, with a local dimming technique, different backlights corresponding to different display areas on a liquid crystal display (LCD) can be turned on with different intensity according to an image data required to be displayed, to save power consumption.

For example, if an image data includes a brighter image in a display area and a darker image in another display area, with a local dimming technique, a cold cathode fluorescent lamp (CCFL) or a light emitting diode (LED) utilized as a backlight of the display area may be controlled to turn on with a brighter backlight intensity, and those of the another display area may be controlled to turn on with a darker backlight intensity. Therefore, in comparison with the total backlights turned on with maximum backlight intensity under a normal operation, power consumption can be saved if a local dimming technique is applied.

In such a condition, since performing the local dimming technique may reduce backlight intensity of parts of the display areas in the LCD, in order to prevent a user from being influenced by the intensity loss, the conventional local dimming technique further increases image intensity, i.e. degree of liquid crystal is polarized for light emission, of the image data for compensated and then displays the image, i.e. compensates the reduced backlight intensity by increasing image intensity, so as to prevent a user from feeling that the displayed image is darker.

On the other hand, in the prior art, the local dimming technique may also be implemented together with a backlight scanning technique. With the backlight scanning technique, the display areas other than those where images are currently displaying are optionally turned off, i.e. when the LCD scans pixels for displaying, only the backlights of the display areas in which image are displaying should be turned on, so as to further save power consumption.

However, the conventional local dimming technique reduces the backlight intensity of parts of the display areas, and then performs brightness compensation with the assumption that total backlights are turned on all the time. The intensity loss caused by optionally turning off parts of the display areas with the backlight scanning technique is not considered. Therefore, when the local dimming technique is implemented together with the backlight scanning technique, the user may still feel that the displayed image is darker. Thus, there is a need for improvement of the prior art.

SUMMARY OF THE INVENTION

It is therefore an objective of the present invention to provide a brightness compensation method and a local dimming circuit and a liquid crystal display (LCD) thereof which can compensate intensity loss with local dimming and backlight scanning simultaneously, to display a normal image.

The present invention discloses a brightness compensation method for an LCD. The brightness compensation method includes performing local dimming to a plurality of display areas of the LCD according to an image data, to control a plurality of backlights of the plurality of display areas to turn on with a plurality of backlight intensity; calculating a plurality of total backlight intensity of the plurality of display areas according to a plurality of leakage coefficients; calculating a plurality of actual backlight intensity of the plurality of display areas according to the plurality of total backlight intensity and a backlight scanning ratio; dividing a plurality of maximum backlight intensity when the plurality of backlights are fully turned on by the plurality of actual backlight intensity, to generate a plurality of compensation gains; and displaying a compensated image data with a plurality of compensated image intensity after compensating a plurality of image intensity corresponding to the plurality of display areas of the image data with the plurality of compensation gains.

The present invention further discloses a local dimming circuit for an LCD, coupled to a timing controller and a backlight driving circuit, for receiving an image data and performing the above brightness compensation method.

The present invention further discloses an LCD, including a liquid crystal screen, which includes a plurality of display areas; a plurality of backlights, corresponding to the plurality of display areas; a backlight driving circuit, for controlling the plurality of backlights to turn on with a plurality of backlight intensity; a timing controller, for receiving a compensated image data with a plurality of compensated image intensity; and a local dimming circuit, for receiving an image data and performing the above brightness compensation method.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
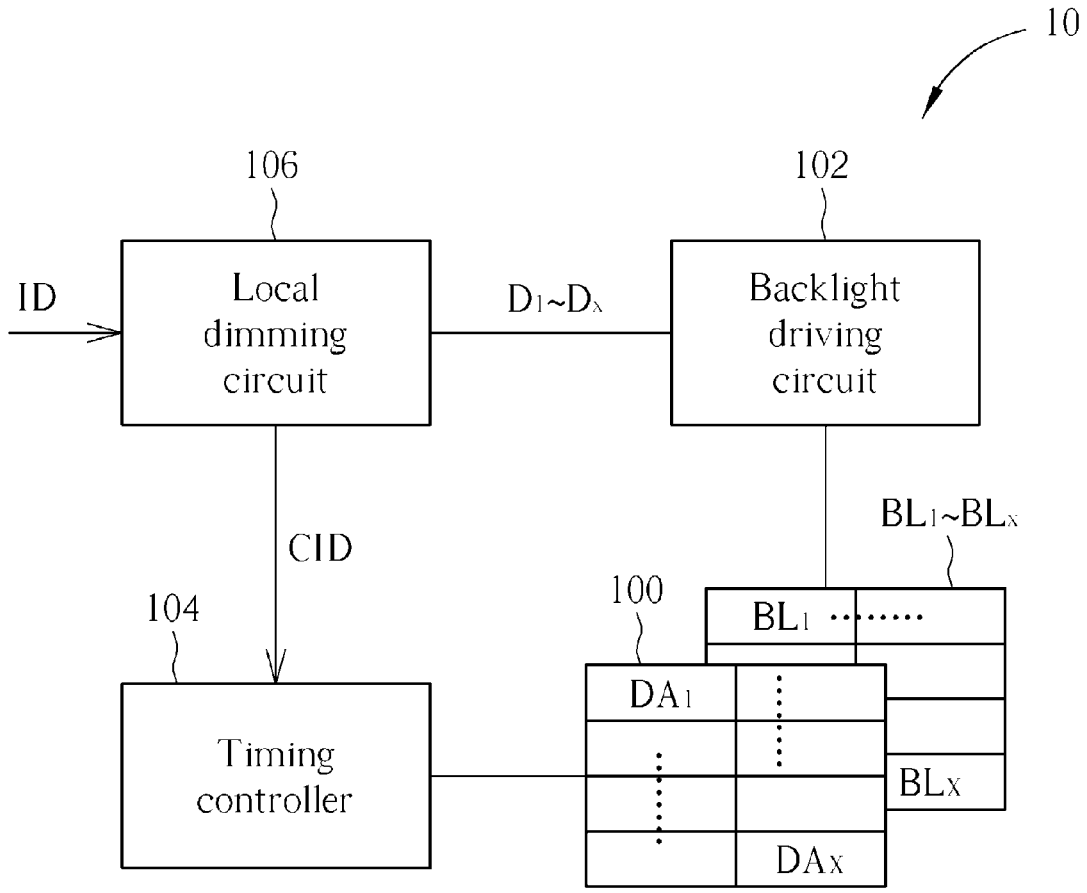
FIG. 1 is a schematic diagram of an LCD according to an embodiment of the present invention.

Please refer to FIG. 1. FIG. 1 is a schematic diagram of an LCD 10 according to an embodiment of the present invention. As shown in FIG. 1, the LCD 10 includes a liquid crystal screen 100, backlights $BL_1$~$BL_x$, a backlight driving circuit 102, a timing controller 104, and a local dimming circuit 106. In short, the liquid crystal screen 100 includes display areas $DA_1$~$DA_x$. The backlights $BL_1$~$BL_x$ are preferably light emitting diodes (LEDs), and located behind the display areas $DA_1$~$DA_x$, respectively, for providing back-lights. The local dimming circuit 106 receives an image data ID, and then indicates the backlight driving circuit 102 to control the backlights $BLI_1$~$BLI_x$ to turn on with backlight intensity $BLI_1$~$BLI_x$ according to the image data ID, and generates compensated image data CID for the timing controller 104, such that the timing controller 104 controls the liquid crystal screen 100 to display the compensated image data CID.

Figure 2:
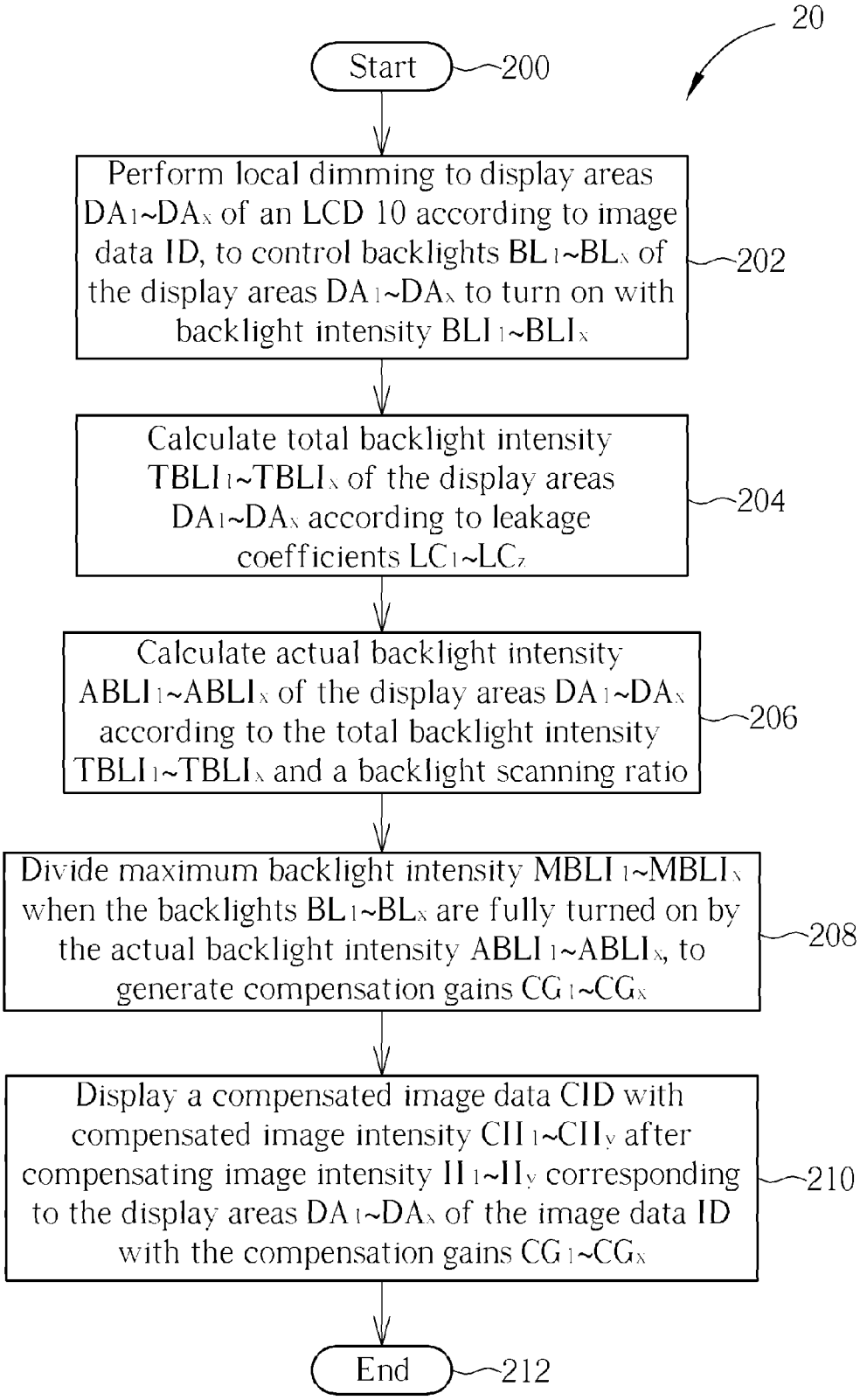
FIG. 2 is a schematic diagram of a brightness compensation process according to an embodiment of the present invention.

In detail, brightness compensation operation of the LCD 10 can be summarized into a brightness compensation process 20, as shown in FIG. 2. The brightness compensation process 20 comprises the following steps:

Step 200: Start.

Step 202: Perform local dimming to the display areas $DA_1$~$DA_x$ of the LCD 10 according to the image data ID, to control the backlights $BL_1$~$BL_x$ of the display areas $DA_1$~$DA_x$ to turn on with the backlight intensity $BLI_1$~$BLI_x$.

Step 204: Calculate total backlight intensity $TBLI_1$~$TBLI_x$ of the display areas $DA_1$~$DA_x$ according to leakage coefficients $LC_1$~$LC_z$.

Step 206: Calculate actual backlight intensity $ABLI_1$~$ABLI_x$ of the display areas $DA_1$~$DA_x$ according to the total backlight intensity $TBLI_1$~$TBLI_x$ and a backlight scanning ratio.

Step 208: Divide maximum backlight intensity $MBLI_1$~$MBLI_x$ when the backlights $BL_1$~$BL_x$ are fully turned on by the actual backlight intensity $ABLI_1$~$ABLI_x$, to generate compensation gains $CG_1$~$CG_x$.

Step 210: Display the compensated image data CID with compensated image intensity $CII_1$~$CII_y$ after compensating image intensity $II_1$~$II_y$ corresponding to the display areas $DA_1$~$DA_x$ of the image data ID with the compensation gains $CG_1$~$CG_x$.

Step 212: End.

According to the brightness compensation process 20, after receiving the image data ID, the local dimming circuit 106 may perform local dimming to the display areas $DA_1$~$DA_x$ of the LCD 10 according to the image data ID, to indicate the backlight driving circuit 102 to control the backlights $BL_1$~$BL_x$ of the display areas $DA_1$~$DA_x$ to turn on with the backlight intensity $BLI_1$~$BLI_x$. For example, the local dimming circuit 106 can calculate maximum image intensity of each pixel in the display areas $DA_1$~$DA_x$ and then draw a histogram accordingly, so as to determine degrees of the backlight intensity $BLI_1$~$BLI_x$ for turning on the backlights $BL_1$~$BL_x$ according to the image intensity $II_1$~$II_y$ corresponding to all pixels in the display areas $DA_1$~$DA_x$ of the image data ID, i.e. backlights corresponding to the display areas $DA_1$~$DA_x$ with higher image intensity are turned on with higher backlight intensity, and backlights corresponding to the display areas $DA_1$~$DA_x$ with lower image intensity are turned on with lower backlight intensity, so as to save power consumption. The local dimming circuit 106 can generate duty cycles $D_1$~$D_x$ for the backlight driving circuit 102 according to the image intensity $II_1$~$II_y$ corresponding to the display areas $DA_1$~$DA_x$ of the image data ID, such that the backlight driving circuit 102 control the backlights $BL_1$~$BL_x$ to turn on with the backlight intensity $BLI_1$~$BLI_x$ with duty cycles $D_1$~$D_x$. For example, the backlight driving circuit 102 utilizes pulse width modulation (PWM) or other methods to modulate degrees of the backlight intensity $BLI_1$~$BLI_x$ of the backlights $BL_1$~$BL_x$.

Then, since the backlights corresponding to the display areas around each display area can also provide back-lights to the each display area, i.e. through leakage, and not only the corresponding backlight provides back-light to the each display area when the display areas $DA_1$~$DA_x$ is displaying image, the local dimming circuit 106 can calculate the total backlight intensity $TBLI_1$~$TBLI_x$ of the display areas $DA_1$~$DA_x$ according to the leakage coefficients $LC_1$~$LC_z$. For example, the local dimming circuit 106 performs convolution to the backlight intensity $BLI_1$~$BLI_x$ and the leakage coefficients $LC_1$~$LC_z$, to calculate the respective total backlight intensity $TBLI_1$~$TBLI_x$ of the display areas $DA_1$~$DA_x$, i.e. multiply the backlight intensity corresponding to the display areas around each display area by the leakage coefficient to that display area, to sum up the backlight intensity due to leakage with the backlight intensity of each backlight corresponding to each display area.

Then, since the backlight driving circuit 102 may turn off backlights corresponding to the display areas other than those where images are displaying according to a backlight scanning ratio when the local dimming technique is implemented together with a backlight scanning technique, the local dimming circuit 106 may further calculate the actual backlight intensity $ABLI_1$~$ABLI_x$ of the display areas $DA_1$~$DA_x$ according to the total backlight intensity $TBLI_1$~$TBLI_x$ and the backlight scanning ratio, i.e. the local dimming circuit 106 multiplies the total backlight intensity $TBLI_1$~$TBLI_x$ calculated when the above backlights $BL_1$~$BL_x$ are turned on all the time, by a ratio of the backlights $BL_1$~$BL_x$ turned on with backlight scanning, so as to obtain the actual backlight intensity $ABLI_1$~$ABLI_x$ of the display areas $DA_1$~$DA_x$ when the local dimming technique is implemented together with the backlight scanning technique.

Finally, the backlight driving circuit 102 further divides the maximum backlight intensity $MBLI_1$~$MBLI_x$ when the backlights $BL_1$~$BL_x$ are fully turned on by the actual backlight intensity $ABLI_1$~$ABLI_x$, to generate the compensation gains $CG_1$~$CG_x$. Therefore, the backlight driving circuit 102 compensates the image intensity $II_1$~$II_y$ corresponding to the display areas $DA_1$~$DA_x$ of the image data ID with the compensation gains $CG_1$~$CG_x$, and then the timing controller 104 controls the LCD 100 to display the compensated image data CID with the compensated image intensity $CII_1$~$CII_y$. In other words, since the compensation gains $CG_1$~$CG_x$ are ratios of the maximum backlight intensity $MBLI_1$~$MBLI_x$ under normal condition to the actual backlight intensity $ABLI_1$~$ABLI_x$ when performing local dimming together with backlight scanning. Therefore, when the compensated image data CID is displayed with the compensated image intensity $CII_1$~$CII_y$ generated from multiplying the image intensity $II_1$~$II_y$ by the compensation gains $CG_1$~$CG_x$, a user may not feel that the displayed image is darker due to local dimming and backlight scanning.

In such a condition, the present invention considers backlight intensity loss caused by local dimming reducing brightness in parts of display areas, and also considers backlight intensity loss caused by backlight scanning which turns on the backlight discontinuously, i.e. the backlight scanning ratio, to calculate the actual backlight intensity $ABLI_1$~$ABLI_x$, and then multiplies the image intensity $II_1$~$II_y$ of all pixels in the display areas $DA_1$~$DA_x$ by the compensation gains $CG_1$~$CG_x$ to obtain the compensated image intensity $CII_1$~$CII_y$. As a result, the present invention can accurately compensate backlight intensity loss caused by local dimming and backlight scanning by increasing image intensity, e.g. the timing controller 104 can increase driving capability of source control signal to increase degree of liquid crystal polarized for light emission, such that a user may not feel that the displayed image is darker due to local dimming and backlight scanning.

Noticeably, the spirit of the present invention is to consider backlight intensity loss due to both local dimming which reduces brightness in parts of display areas and backlight scanning which turns on the backlights discontinuously, and to calculate the actual backlight intensity $ABLI_1$~$ABLI_x$ so as to increase image intensity to compensate backlight intensity loss caused by local dimming and backlight scanning, such that a user may not feel that the displayed image is darker due to local dimming and backlight scanning. Those skilled in the art can make modifications and alterations accordingly. For example, the local dimming circuit 106 can be integrated into a main chip, but can also be implemented independently. Besides, in the above embodiment, the implementation of Step 202 is to determine degrees of the backlight intensity $BLI_1$~$BLI_x$ to turn on the backlights $BL_1$~$BL_x$ after directly calculating maximum image intensity of each pixel in the display areas $DA_1$~$DA_x$. In other embodiments, Step 202 can also determine degrees of the backlight intensity $BLI_1$~$BLI_x$ of the backlights $BL_1$~$BL_x$ with a recursive way according to the image data ID and actual backlight intensity $ABLI_1'$-$ABLI_x'$ of a previous image data ID', e.g. a previous frame.

In detail, the local dimming circuit 106 normalizes the actual backlight intensity $ABLI_1'$-$ABLI_x'$ obtained from the previous image data ID' by Step 206, and then draws histogram according to the difference between the image intensity $II_1$~$II_y$ corresponding to the display areas $DA_1$~$DA_x$ of the image data ID and the actual backlight intensity $ABLI_1'$-$ABLI_x'$ of the previous image data ID', so as to determine backlight intensity offsets $OF_1$~$OF_x$. Then, the local dimming circuit 106 compensates the backlight intensity $BLI_1'$-$BLI_x'$ of the previous image data ID' with the backlight intensity offsets $OF_1$~$OF_x$, to control the backlights $BL_1$~$BL_x$ to turn on with the backlight intensity $BLI_1$~$BLI_x$. In such a situation, since the backlights corresponding to the display areas around each display area can also provide back-lights when the display areas $DA_1$~$DA_x$ is displaying image, the backlight intensity obtained by considering the leakage is more accurate, and the difference between the image intensity $II_1$~$II_y$ and the actual backlight intensity $ABLI_1'$-$ABLI_x'$ of the previous image data ID' indicates that degrees of the backlight intensity $BLI_1'$-$BLI_x'$ utilized in the previous image data ID' is required to change so as to obtain degrees of the backlight intensity $BLI_1$~$BLI_x$ which can display the image data ID properly, e.g. change duty cycles $D_1'$~$D_x'$ utilized in a previous frame so as to obtain the duty cycles $D_1$~$D_x$ in a current frame. As a result, an embodiment of the present invention can utilize a recursive way to determine degrees of the backlight intensity $BLI_1$~$BLI_x$ of the backlights $BL_1$~$BL_x$ accurately when utilizing local dimming.

In the prior art, the local dimming technique reduces the backlight intensity in parts of the display areas, and then performs brightness compensation with the assumption that total backlights are turned on all the time. Intensity loss caused by optionally turning off parts of the display areas with the backlight scanning technique is not considered. Therefore, when the local dimming technique is implemented together with the backlight scanning technique, the user may still feel that the displayed image is darker. In comparison, the present invention considers backlight intensity loss due to both local dimming which reduces brightness in parts of display areas and backlight scanning which turns on the backlights discontinuously, and calculates the actual backlight intensity $ABLI_1$~$ABLI_x$ so as to increase image intensity to compensate backlight intensity loss caused by local dimming and backlight scanning, such that a user may not feel that the displayed image is darker due to local dimming and backlight scanning.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A brightness compensation method for a liquid crystal display (LCD), comprising:

performing local dimming to a plurality of display areas of the liquid crystal display according to an image data, to control a plurality of backlights of the plurality of display areas to turn on with a plurality of backlight intensity;

calculating a plurality of total backlight intensity of the plurality of display areas according to a plurality of leakage coefficients;

calculating a plurality of actual backlight intensity of the plurality of display areas according to the plurality of total backlight intensity and a backlight scanning ratio;

dividing a plurality of maximum backlight intensity when the plurality of backlights are fully turned on by the plurality of actual backlight intensity, to generate a plurality of compensation gains; and displaying a compensated image data with a plurality of compensated image intensity after compensating a plurality of image intensity corresponding to the plurality of display areas of the image data with the plurality of compensation gains;

wherein the step of performing local dimming to the plurality of display areas of the liquid crystal display according to the image data, to control the plurality of backlights of the plurality of display areas to turn on with the plurality of backlight intensity comprises:

determining degrees of the plurality of backlight intensity with a recursive way according to the image data and a plurality of actual backlight intensity of a previous image data and normalizing the plurality of actual backlight intensity of the previous image data before calculating a difference between the plurality of image intensity of the plurality of display areas corresponding to the image data and the plurality of actual backlight intensity of the previous image data.

2. The brightness compensation method of claim 1, wherein the step of performing local dimming to the plurality of display areas of the liquid crystal display according to the image data, to control the plurality of backlights of the plurality of display areas to turn on with the plurality of backlight intensity comprises:

determining degrees of the plurality of backlight intensity for turning on the plurality of backlights according to the plurality of image intensity corresponding to the plurality of display areas of the image data.

3. The brightness compensation method of claim 1, wherein the step of performing local dimming to the plurality of display areas of the liquid crystal display according to the image data, to control the plurality of backlights of the plurality of display areas to turn on with the plurality of backlight intensity comprises:

controlling the plurality of backlights to turn on with the plurality of backlight intensity with a plurality of duty cycles according to the image data.

4. The brightness compensation method of claim 1, wherein the step of calculating the plurality of total backlight intensity of the plurality of display areas according to the plurality of leakage coefficients comprises:

performing convolution to the plurality of backlight intensity and the plurality of leakage coefficients, to calculate the plurality of total backlight intensity of the plurality of display areas.

5. The brightness compensation method of claim 1, wherein the step of performing local dimming to the plurality of display areas of the liquid crystal display according to the image data, to control the plurality of backlights of the plurality of display areas to turn on with the plurality of backlight intensity comprises:

determining a plurality of backlight intensity offsets according to the difference between the plurality of image intensity of the plurality of display areas corresponding to the image data and the plurality of actual backlight intensity of the previous image data.

6. The brightness compensation method of claim 5, further comprising:

compensating the plurality of backlight intensity of the previous image data with the plurality of backlight intensity offsets, to control the plurality of backlights to turn on with the plurality of backlight intensity.

7. A local dimming circuit for a liquid crystal display (LCD), coupled to a timing controller and a backlight driving circuit, for receiving an image data and performing the brightness compensation method of claim 1.

8. A liquid crystal display (LCD), comprising:

a liquid crystal screen, comprising a plurality of display areas;

a plurality of backlights, corresponding to the plurality of display areas;

a backlight driving circuit, for controlling the plurality of backlights to turn on with a plurality of backlight intensity;

a timing controller, for receiving a compensated image data with a plurality of compensated image intensity; and a local dimming circuit, for receiving an image data and performing the brightness compensation method of claim 1.

* * * * *